US007765985B2

(12) United States Patent
Liskow

(10) Patent No.: US 7,765,985 B2
(45) Date of Patent: Aug. 3, 2010

(54) INTERMEDIATE ELEMENT FOR A FUEL INJECTOR

(75) Inventor: Uwe Liskow, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 164 days.

(21) Appl. No.: 11/883,192

(22) PCT Filed: Jan. 19, 2006

(86) PCT No.: PCT/EP2006/050301

§ 371 (c)(1),
(2), (4) Date: May 13, 2008

(87) PCT Pub. No.: WO2006/097374

PCT Pub. Date: Sep. 21, 2006

(65) Prior Publication Data

US 2009/0050113 A1 Feb. 26, 2009

(30) Foreign Application Priority Data

Mar. 14, 2005 (DE) ..... 10 2005 011 574

(51) Int. Cl.
*F02M 61/14* (2006.01)
*F02M 61/18* (2006.01)

(52) U.S. Cl. ..... 123/470

(58) Field of Classification Search ..... 123/470, 123/468, 469, 467, 456, 198 D; 239/533.11, 239/600; 277/313, 591–596
See application file for complete search history.

(56) References Cited

U.S. PATENT DOCUMENTS

| | | | | |
|---|---|---|---|---|
| 4,428,593 | A * | 1/1984 | Pearlstein | 277/596 |
| 4,714,260 | A | 12/1987 | Udagawa | |
| 5,642,862 | A * | 7/1997 | Wakeman et al. | 239/585.4 |
| 6,343,795 | B1 * | 2/2002 | Zerfass et al. | 277/593 |
| 6,422,481 | B2 * | 7/2002 | Ren et al. | 239/13 |
| 6,477,940 | B1 * | 11/2002 | Danckert et al. | 92/172 |
| 6,585,272 | B2 * | 7/2003 | Inamura et al. | 277/592 |
| 2002/0139352 | A1 | 10/2002 | Schroeer | |
| 2002/0152995 | A1 | 10/2002 | Kato | |
| 2004/0040543 | A1 * | 3/2004 | Mickelson | 123/470 |

FOREIGN PATENT DOCUMENTS

| | | |
|---|---|---|
| DE | 10108466 | 9/2002 |
| EP | 0825342 | 2/1998 |
| EP | 1193392 | 4/2002 |
| JP | 48-42984 | 6/1973 |
| JP | 55-124659 | 9/1980 |
| JP | 63-96362 | 4/1988 |
| JP | 2-179738 | 7/1990 |
| JP | 4-86253 | 3/1992 |
| JP | 4-290631 | 10/1992 |
| JP | 5-231573 | 9/1993 |

(Continued)

*Primary Examiner*—Mahmoud Gimie
(74) *Attorney, Agent, or Firm*—Kenyon & Kenyon LLP

(57) ABSTRACT

An intermediate element for a fuel injector situated in a cylinder head of an internal combustion engine is disposed between a valve housing of the fuel injector and a wall of a receiving bore of the cylinder head, and/or between the valve housing and a clamping shoe holding the fuel injector down in the cylinder head. The intermediate element is made up of a plurality of layers having different patterning and/or being made of different materials.

27 Claims, 4 Drawing Sheets

FOREIGN PATENT DOCUMENTS

| | | |
|---|---|---|
| JP | 6-294329 | 10/1994 |
| JP | 8-25444 | 10/1996 |
| JP | 10-138374 | 5/1998 |
| JP | 11 210885 | 8/1999 |
| JP | 2003-3931 | 1/2003 |
| JP | 2004-506136 | 2/2004 |

* cited by examiner

INTERMEDIATE ELEMENT FOR A FUEL INJECTOR

RELATED ART

The present invention is based on an intermediate element for a fuel injector.

From DE 101 08 466 A1, for instance, an intermediate element for supporting a fuel injector in a cylinder head of an internal combustion engine is known. The intermediate element is in the form of an annular washer and situated between a valve housing of the fuel injector and a wall of a receiving bore of the cylinder head. The annular washer has a round or oval cross section, and a shoulder of the valve housing is set apart from a shoulder of the cylinder head by the annular washer.

A particular disadvantage of known annular washers is that, although the positioning of the fuel injector in the cylinder head is able to be corrected, the solid design of the annular washer made of wire, copper, steel or similar materials creates a structure-borne noise bridge between the fuel injector and the cylinder head. This transmits the structure-borne noise, which is generated in the fuel injector by the switching pulses, to other components of the internal combustion engine and generates annoying noise.

SUMMARY OF THE INVENTION

In contrast, the intermediate element for a fuel injector according to the present invention, has the advantage that a suitable design of an intermediate element between the fuel injector and the cylinder head and/or between the fuel injector and a pinning-down clamping shoe, or a spring element, effects a decoupling of the fuel injector, which reduces the transmission of structure-borne noise to other components of the internal combustion engine. The intermediate element has a plurality of layers, i.e., at least three layers, which have different forms and/or are made of different materials.

The measures specified in the dependent claims make possible advantageous further refinements and improvements of the intermediate element indicated in the main claim.

In particular, it is advantageous that the number of intermediate layers is variable and adaptable to the given situation.

In an advantageous manner, the layers are provided with patterning, which may take the form of a corrugated sheet, wafer or honeycomb.

The patterns of adjacent layers may be arranged in an in-phase manner, in phase opposition or rotated with respect to each other in order to allow only point-wise contact of adjacent layers so as to dampen the structure-borne noise in this manner.

The layers may be implemented by different methods during the manufacturing process, by soldering, welding, crimping, clamping or compressing, for instance. A cup-shaped design of the bottom layer facilitates the connection.

The interconnection of the layers may be implemented both only radially on the outside as well as radially on the outside and on the inside.

The cavities between the intermediate layers may be provided with suitable fillers such as metal shavings or balls of materials such as metal, plastic, or mineral balls in order to dampen the structure-borne noise even further.

Moreover, it is advantageous that the layers alternately may be made of metal and plastics and/or materials containing carbon fiber.

BRIEF DESCRIPTION OF THE DRAWING

Exemplary embodiments of the present invention are depicted in simplified fashion in the drawings and explained in greater detail in the description below. The figures show.

DESCRIPTION OF THE EXEMPLARY EMBODIMENTS

Figure 1:
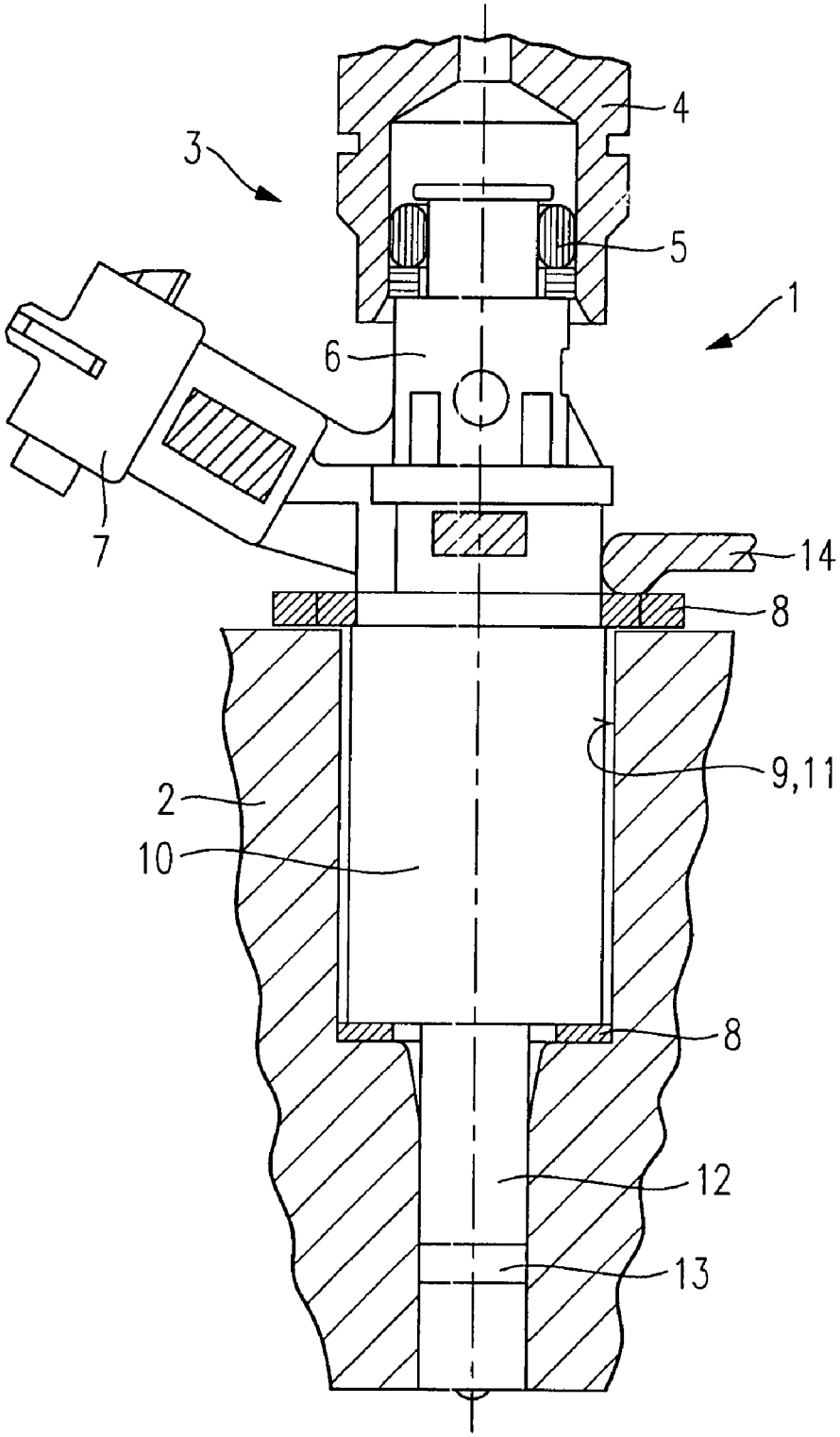
FIG. 1 a schematic, part-sectional view of an exemplary embodiment of a fuel injector in a cylinder head of an internal combustion engine, the fuel injector being equipped with an intermediate element configured according to the present invention.

FIG. 1 shows a schematized part-sectional view through an exemplary embodiment of a fuel injector 1 equipped with an intermediate element 8 according to the present invention, in a receiving bore of a cylinder head of a mixture-compressing internal combustion engine having externally supplied ignition.

Here, a fuel injector 1 is designed as a directly injecting fuel injector 1 and installed in a cylinder head 2 of an internal combustion engine. At an end 3 on the intake side, fuel injector 1 is provided with a plug connection to a fuel-distributor line 4, which is sealed by a seal 5 between fuel-distributor line 4 and a supply connection 6 of fuel injector 1. Fuel injector 1 has an electrical connection 7 for the electrical contacting in order to actuate fuel injector 1.

According to the present invention, fuel injector 1 has an intermediate element 8 in receiving bore 9 of cylinder head 2, between a wall 11 of receiving bore 9 and a valve housing 10 of fuel injector 1, and/or between valve housing 10 and a clamping shoe 14 on the side of the cylinder head, or a spring element, by which fuel injector 1 is held down in cylinder head 2 of the internal combustion engine, the intermediate element serving the purpose of decoupling the structure-borne noise and simultaneously regulating the position of fuel injector 1.

Intermediate element 8 thus fulfills several functions. On the one hand, the introduction of structure-borne noise of fuel injector 1 into cylinder head 2 and into additional components of the internal combustion engine is reduced. This is desirable since fuel injectors 1, in particular piezoelectrically actuated fuel injectors 1, generate very high structure-borne noise excitations at the installation location in cylinder head 2 due to the high switching forces and the short trigger pulses. Furthermore, given the multiple injections that are prevalent today, the structure-borne noise is amplified further by the increased number of injection pulses.

Moreover, by setting fuel injector 1 apart from a wall 11 of receiving bore 9, centering of fuel injector 1 is able to be achieved, which counteracts tilting of fuel injector 1, for example in the region of a nozzle body 12 of fuel injector 1, and thereby contributes to the sealing action of a sealing ring 13, which is slipped onto nozzle body 11 and seals cylinder head 2 from the combustion chamber (not shown further) of the internal combustion engine.

In addition, without requiring expensive reworking of the components, intermediate element 8 is able to compensate for manufacturing tolerances of the individual components, such as nozzle body 12 or valve housing 10, which lead to asymmetries in fuel injector 1.

Intermediate element 8 may also compensate for temperature-related tolerances that may occur as a result of warming of fuel injector 1 and of cylinder head 2 during operation of the internal combustion engine. For instance, tolerances of this type may lead to stressing and warping of the plug connection between fuel injector 1 and fuel distributor line 4.

In the following text, exemplary embodiments for intermediate elements 8 configured according to the present invention and schematically shown in the figures of the drawing will be elucidated in greater detail.

Figure 2A:
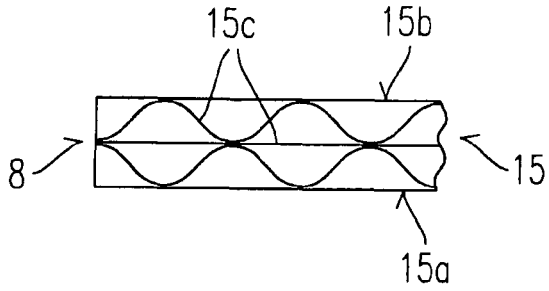
FIGS. 2A-C three exemplary embodiments of the configuration of an intermediate element designed according to the present invention.
Figure 2B:
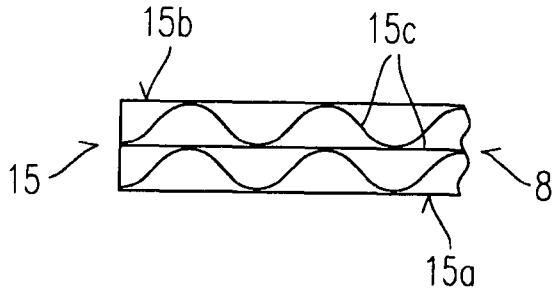
Figure 2C:
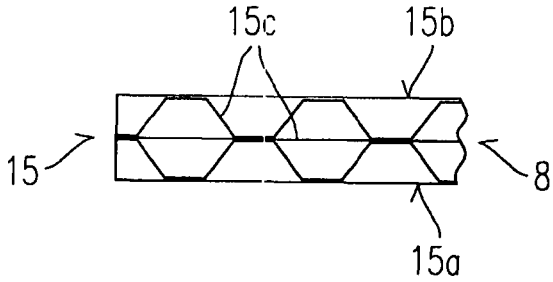

FIGS. 2A through 2C show heavily schematized exemplary embodiments for intermediate elements 8 configured according to the present invention, in a sectional side view.

According to the present invention, intermediate elements 8 are made up of a plurality of layers 15 such as three to five, which may have different forms and/or may be made of different materials. Layers 15 are made from sheet metal, for instance, having a material strength of approx. 0.1 to 0.5 mm or less. At least one of layers 15 has patterning that prevents an all-over contact at abutting layers 15 and thereby prevents the transmission of structure-borne noise.

The exemplary embodiments according to FIG. 2A through 2C each have a bottom layer 15*a*, a cover layer 15*b*, as well as a plurality of intermediate layers 15, of which there are three in the exemplary embodiment. Intermediate layers 15*c* must be made of non-degradable materials and materials that are dimensionally stable over the service life of fuel injector 1.

Intermediate layers 15*c* in the exemplary embodiments shown have patterning in a corrugated-sheet or wafer form, which is able to be produced by, for instance, stamping or deep-drawing with material strengths of tenths, hundredths or thousands of millimeters. The patterning may be arranged in phase-opposition (FIG. 2A) or in phase (FIG. 2B) with respect to each other. Intermediate layers 15*c* may also have a trapezoidal cross-section (FIG. 2C), and the trapezoidal patterning may likewise be arranged in phase or in phase opposition. Due to the fact that individual layers 15 of intermediate element 8 do not make contact allover, but only along lines, effective damping of the structure-borne noise is able to be achieved.

Figure 3A:
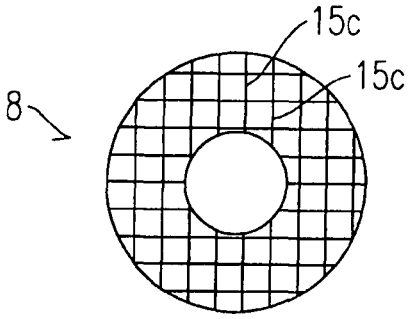
FIGS. 3A-C two additional exemplary embodiments of the configuration of an intermediate element designed according to the present invention.
Figure 3B:
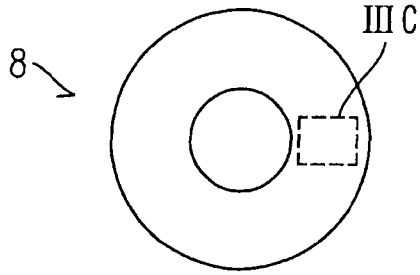

A further improvement in the decoupling may be realized if intermediate layers 15*c* provided with the patterning are rotated with respect to each other, at an angle of approximately 90°, for instance, as illustrated in FIG. 3A in a heavily schematized manner. This reduces the contact surfaces to individual points, which causes even less structure-borne noise to be transmitted.

Figure 3C:
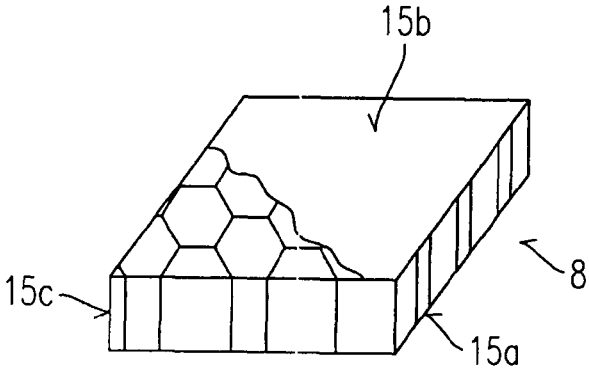

A similarly effective result is shown in the exemplary embodiment according to FIG. 3C in which a honeycomb-like pattern for intermediate layer 15*c*, of which there is only one, is provided.

Layers 15 of intermediate element 8 may be interconnected in a variety of ways in order to prevent displacement of layers 15 with respect to each other. Methods such as, in particular, beading, crimping, welding or soldering may be considered.

Figure 4A:
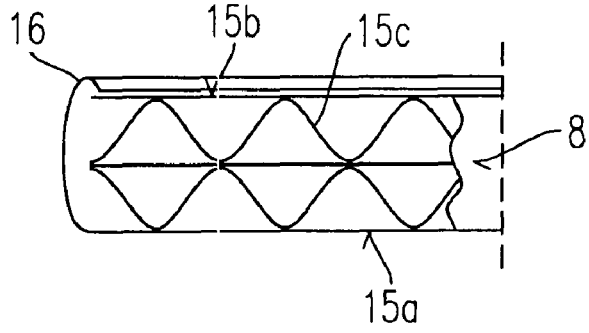
FIG. 4A-B a first exemplary embodiment of the connection of the layers of intermediate elements according to the present invention.
Figure 4B:
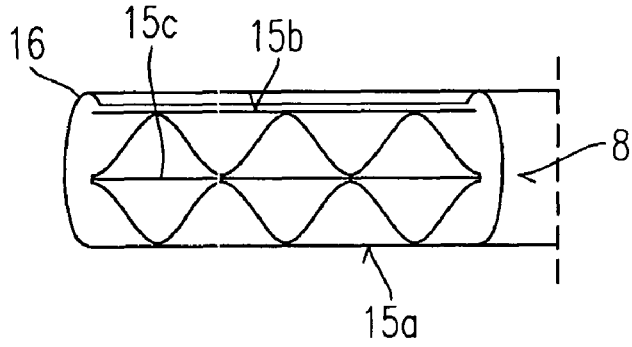

FIGS. 4A and 4B show one possible type of connection using a projecting, form-fitting collar 16, which is integrally formed with bottom layer 15*a* in the shape of a cup. Collar 16, as illustrated in FIG. 4A, may be formed only radially on the outside in order to prevent sliding of layers 15 in this manner. Intermediate element 8 then remains open radially toward the inside and has a certain susceptibility with respect to transverse forces. This may be countered by affixing collar 16 radially on the inside as well, as can be gathered from FIG. 4B.

The introduction of force into intermediate element 8 must be implemented only to bottom or cover layer 15*a*, 15*b*, respectively, since a rigid design of cup-shaped bottom layer 15*a* would in turn form a bridge for structure-borne noise. Therefore, it must be ensured that clamping shoe 14 abuts only against cover layer 15*b*, or that the diameter of intermediate element 8 in the installation position in cylinder head 2 is adapted to the diameter of valve housing 10, so that a force introduction via bottom or cover layer 15*a*, 15*b*, respectively, and not via collar 16, takes place here as well.

Figure 5A:
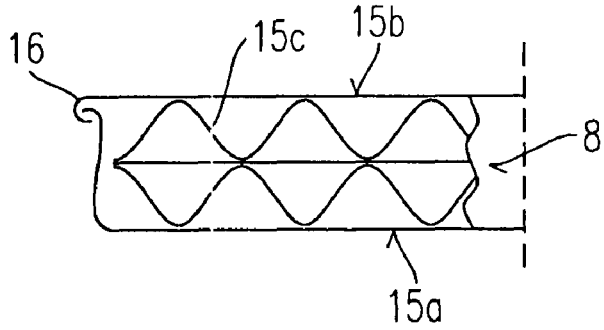
FIG. 5A-B a second exemplary embodiment of the connection of the layers of intermediate elements according to the present invention.
Figure 5B:
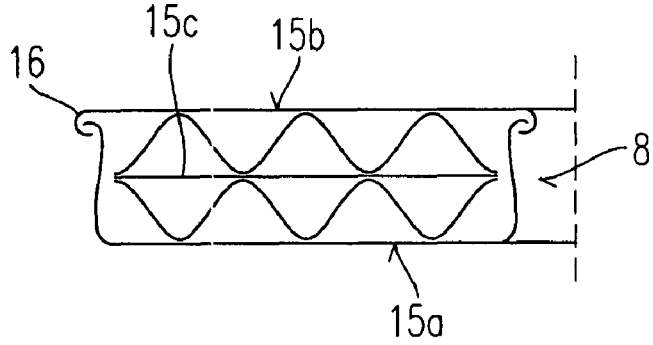

Another type of connection is beading, which is illustrated in FIGS. 5A and 5B in the same representation as in FIGS. 4A and 4B. Collar 16 is formed by cover layer 15*b* and beaded with cup-shaped bottom layer 15*a*. This may likewise be implemented only radially outside or radially outside and inside.

Figure 6A:
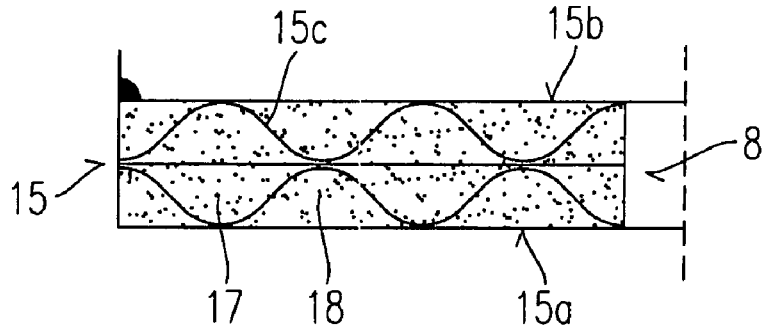
FIG. 6A-B two additional exemplary embodiments of intermediate elements configured according to the present invention.
Figure 6B:
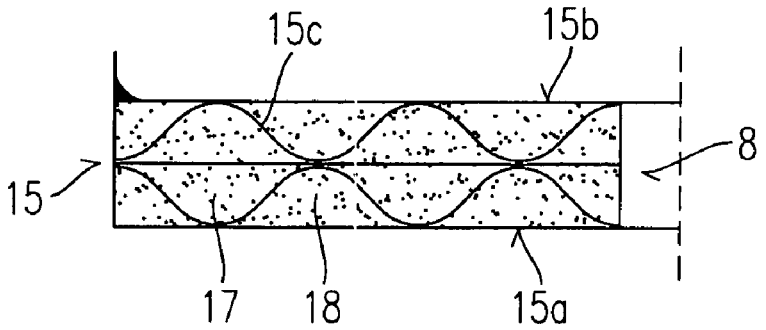

FIGS. 6A and 6B show additional types of connection of bottom and cover layers 15*a*, 15*b*, respectively, as well as an additional advantageous embodiment of intermediate layers 15*c* for damping the structure-borne noise.

The connection between layers 15 may also be implemented with the aid of welding or soldering, by welding or soldering cover layer 15*b* to bottom layer 15*a*, which is again drawn upward in the shape of a cup. It is no longer necessary to form a collar 16, which is why this form of connection is able to be especially easy to produce.

Furthermore, as can be gathered from FIGS. 6A and 6B, cavities 17 situated between intermediate layers 15*c* may be filled with suitable filler material 18 such as metal shavings, metal balls or plastic balls in order to further dampen the transmission of structure-borne noise.

Figure 7:
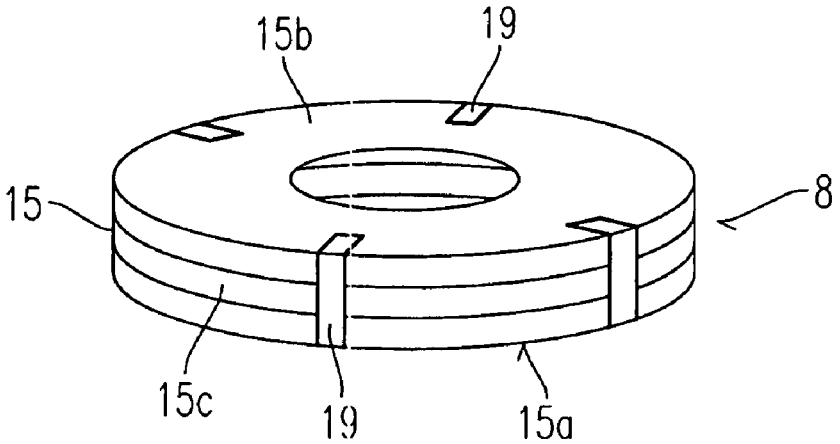
FIG. 7 an exemplary embodiment of an intermediate element configured according to the present invention, including clamps.

Another possibility for assembling layers 15 in packets is schematically illustrated in FIG. 7, where the connection is implemented mechanically, by clamps 19 that enclose layers 15.

Finally, it is also conceivable to set layers 15 during the production process of intermediate element 8, using a force that is considerably higher than the operating force, by a factor of 1.2 to 2, for example. Layers 15 may be interconnected in this manner as well.

In order to further simplify the production of intermediate element 8, it is likewise conceivable to dispense with intermediate layers 15*c* provided with patterning and instead replace them by intermediate layers 15*c* made of plastic, or by intermediate layers 15*c* reinforced by carbon fiber. The materials used in this connection must be temperature-stable up to approx. 150° C., and relaxation-free.

The present invention is not limited to the exemplary embodiments shown and, for example, is also applicable to fuel injectors 1 for injection into the combustion chamber of a self-igniting internal combustion engine. All features of the present invention may be combined with one another as desired.

What is claimed is:

1. An intermediate element for a fuel injector situated in a cylinder head of an internal combustion engine, the intermediate element being situated between a valve housing of the fuel injector and a wall of a receiving bore of the cylinder head, and/or between the valve housing and a clamping shoe holding the fuel injector down in the cylinder head, or a spring element, the intermediate element comprising:

a plurality of layers having different patterning;

wherein the number of layers is at least three, one bottom layer, one cover layer, and at least one intermediate layer disposed in-between being provided;

wherein the at least one intermediate layer has one of a honeycomb and a waffle-type pattern.

2. The intermediate element as recited in claim 1, wherein the at least one intermediate layer has a wave-like pattern.

3. The intermediate element as recited in claim 1, wherein the patterning is able to be produced by stamping or deep-drawing.

4. The intermediate element as recited in claim 3, wherein the size of the patterning is in an order of magnitude of between 1/1000 to 1/10 mm.

5. The intermediate element as recited in claim 4, wherein the material strength of the layers amounts to 0.1 mm to 0.5 mm.

6. The intermediate element as recited in claim 1, wherein the number of intermediate layers amounts to at least two.

7. The intermediate element as recited in claim 6, wherein the wave- or waffle-like patterning of two adjacent intermediate layers is arranged in phase or in phase opposition with respect to each other.

8. The intermediate element as recited in claim 6, wherein the wave- or waffle-like patternings of two adjacent intermediate layers are rotated at an angle with respect to each other.

9. The intermediate element as recited in claim 8, wherein the angle amounts to approximately 90°, for instance.

10. The intermediate element as recited in claim 9, wherein cavities formed in the intermediate layers are filled with fillings.

11. The intermediate element as recited in claim 10, wherein the fillings are made of metal shavings, metal balls, mineral balls or plastic balls.

12. The intermediate element as recited in claim 11, wherein the bottom layer is designed in the shape of a cup.

13. The intermediate element as recited in claim 12, wherein the at least one intermediate layer and the cover layer are inserted in the cup-shaped bottom layer.

14. The intermediate element as recited in claim 13, wherein the layers are interconnected.

15. The intermediate element as recited in claim 14, wherein the cover layer is connected to the cup-shaped bottom layer by soldering or welding.

16. The intermediate element as recited in claim 14, wherein the bottom layer has a projection in the form of a circumferential collar.

17. The intermediate element as recited in claim 16, wherein the collar is formed radially on the outside.

18. The intermediate element as recited in claim 16, wherein the collar is formed radially on the inside and radially on the outside.

19. The intermediate element as recited in claim 18, wherein the collar overlaps the cover layer with form locking.

20. The intermediate element as recited in claim 14, wherein the cover layer is beaded with the cup-shaped bottom layer.

21. The intermediate element as recited in claim 20, wherein the beading is implemented radially on the outside.

22. The intermediate element as recited in claim 20, wherein the beading is implemented radially on the inside and radially on the outside.

23. The intermediate element as recited in claim 22, wherein the layers are assembled as a package by hooks, which enclose the layers radially on the outside and/or radially on the inside.

24. The intermediate element as recited in claim 23, wherein the layers are assembled as packages by setting the layers during the manufacturing process.

25. The intermediate element as recited in claim 24, wherein the pressure for setting the layers is 1.2 times to 2 times higher than the operating pressure of the fuel injector.

26. The intermediate element as recited in claim 25, wherein the layers are alternately made of metal and plastic and/or of materials containing carbon fiber.

27. The intermediate element as recited in claim 1, wherein the plurality of layers are made of different materials.

* * * * *